US008439349B2

(12) United States Patent
Matsumoto et al.

(10) Patent No.: US 8,439,349 B2
(45) Date of Patent: May 14, 2013

(54) SHEET FEEDING APPARATUS AND IMAGE FORMING APPARATUS

(75) Inventors: Yuzo Matsumoto, Abiko (JP); Tetsuro Fukusaka, Abiko (JP); Yoshitaka Yamazaki, Abiko (JP); Taishi Tomii, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/215,712

(22) Filed: Aug. 23, 2011

(65) Prior Publication Data

US 2012/0049437 A1 Mar. 1, 2012

(30) Foreign Application Priority Data

Aug. 25, 2010 (JP) ..... 2010-188240

(51) Int. Cl.
*B65H 3/08* (2006.01)

(52) U.S. Cl.
USPC ..... 271/97; 271/98; 271/96; 271/108

(58) Field of Classification Search ..... 271/97, 271/98, 96, 108
See application file for complete search history.

(56) References Cited

U.S. PATENT DOCUMENTS 4,451,021 A * 5/1984 Merriss ..... 248/480
4,451,028 A * 5/1984 Holmes et al. ..... 271/11
6,244,586 B1 * 6/2001 Gauger et al. ..... 271/12
7,575,231 B2 8/2009 Sasaki et al.
7,591,459 B2 9/2009 Matsumoto et al.
7,823,875 B2 11/2010 Fukatsu et al.
2005/0206068 A1 9/2005 Sasaki et al.
2009/0001646 A1 1/2009 Matsumoto
2009/0250865 A1 10/2009 Matsumoto
2009/0267288 A1 10/2009 Sasaki et al.
2010/0295237 A1 11/2010 Matsumoto
2011/0012301 A1 1/2011 Fukatsu et al.
2011/0169211 A1 7/2011 Matsumoto et al.
2011/0278787 A1 11/2011 Fukusaka et al.

* cited by examiner

*Primary Examiner* — Luis A Gonzalez
(74) *Attorney, Agent, or Firm* — Fitzpatrick, Cella, Harper & Scinto

(57) ABSTRACT

A sheet feeding apparatus and an image forming apparatus are provided. Timing when a subsequent sheet is adsorbed by an adsorbing and conveying mechanism of a sheet feeding device which adsorbs and conveys sheets blown up by air blowing is controlled, and the subsequent sheet is conveyed while being overlapped partially at an overlapping amount with a preceding sheet Sa adsorbed by the adsorbing and conveying mechanism earlier regardless of the size, basis weight, and kind of sheets.

16 Claims, 14 Drawing Sheets

FIG. 7

| Name | Basis weight [g/m$^2$] | Adsorbing time [msec] | Conveying speed [mm/sec] | Conveying distance of preceding sheet before adsorption [mm] |
|---|---|---|---|---|
| Ultra-thin paper | 40 or less | 20 | 360 | 7.2 |
| Thin paper | 41 to 52 | 40 | 360 | 14.4 |
| Plain paper | 53 to 160 | 60 | 360 | 21.6 |
| Thick paper | 161 to 249 | 80 | 360 | 28.8 |
| Ultra-thick paper | 250 or more | 100 | 360 | 36 |

FIG. 9

| Name | Basis weight [g/m$^2$] | Adsorbing time [msec] | Conveying speed [mm/sec] | Conveying distance of preceding sheet before adsorption [mm] |
|---|---|---|---|---|
| Ultra-thin paper | 40 or less | 20 | 360 | 7.2 |
| Thin paper | 41 to 52 | 40 | 180 | 7.2 |
| Plain paper | 53 to 160 | 60 | 120 | 7.2 |
| Thick paper | 161 to 249 | 80 | 90 | 7.2 |
| Ultra-thick paper | 250 or more | 100 | 72 | 7.2 |

FIG. 11A

| Name | Basis weight [g/m$^2$] | Suction fan rotating speed [rpm] | Adsorbing time [msec] | Conveying distance of preceding sheet before adsorption [mm] (360 mm/sec) |
|---|---|---|---|---|
| Ultra-thin paper | 40 or less | 1200 | 20 | 7.2 |
| Thin paper | 41 to 52 | 1200 | 40 | 14.4 |
| Plain paper | 53 to 160 | 1200 | 60 | 21.6 |
| Thick paper | 161 to 249 | 1200 | 80 | 28.8 |
| Ultra-thick paper | 250 or more | 1200 | 100 | 36 |

FIG. 11B

| Name | Basis weight [g/m$^2$] | Suction fan rotating speed [rpm] | Adsorbing time [msec] | Conveying distance of preceding sheet before adsorption [mm] (360 mm/sec) |
|---|---|---|---|---|
| Ultra-thin paper | 40 or less | 1200 | 20 | 7.2 |
| Thin paper | 41 to 52 | 2400 | 20 | 7.2 |
| Plain paper | 53 to 160 | 3600 | 20 | 7.2 |
| Thick paper | 161 to 249 | 4800 | 20 | 7.2 |
| Ultra-thick paper | 250 or more | 6000 | 20 | 7.2 |

SHEET FEEDING APPARATUS AND IMAGE FORMING APPARATUS

BACKGROUND OF THE INVENTION

1. Field of the Invention

The present invention relates to a sheet feeding apparatus and an image forming apparatus and more specifically relates to a sheet feeding apparatus and an image forming apparatus which separate and feed sheets by making air blow the sheets.

2. Description of the Related Art

Conventionally, an image forming apparatus such as a printer and a copying machine has a sheet feeding apparatus which feeds sheets loaded on a tray supporting a plurality of sheets one by one. Such a sheet feeding apparatus adopts an air feeding method in which air blows an end portion of a sheet bundle supported on the tray to cause several sheets to be blown up, and in which a sheet is adsorbed by an adsorbing and conveying belt arranged on the upper side to feed the sheets one by one (refer to U.S. Patent Application Publication No. 2005/0206068 A1).

The sheet feeding apparatus adopting this air feeding method makes air blow the end portion on the front end side of the sheet bundle on the tray, causes the sheets to be blown up to loosen the sheets, and makes the adsorbing and conveying belt adsorb the uppermost sheet out of the blown-up sheets by negative pressure. Additionally, the adsorbing and conveying belt adsorbing the sheet is rotated to cause the single sheet to be separated and fed to a downstream. In such a manner, the sheets are separated and fed to an image forming portion one by one. The sheet feeding apparatus in this air feeding method is more durable than a general sheet feeding apparatus in a friction separating method. Thus, the sheet feeding apparatus in this air feeding method is often used in a field of simple book binding (quick printing of booklets or catalogs) with use of the image forming apparatus in xerography enabling Print On Demand (POD).

Recently, there is a demand by users for enhancing productivity (number of images to be formed per unit time) in the image forming apparatus. Especially in the field of the above-mentioned POD (Print On Demand), a large amount of quick printing needs to be performed, and thus the sheet feeding apparatus which has achieved enhancement of productivity is desired. In general, in order to enhance productivity, the number of sheets to be fed from the sheet feeding apparatus per unit time needs to be increased, and to do so, a sheet feeding speed must be raised.

However, to speed up sheet feeding in the sheet feeding apparatus in the air feeding method, the sheets need to be blown up quickly, and a conveying speed of the adsorbing and conveying belt needs to be raised. To cause the sheets to be blown up quickly, an air speed (air quantity) of the blowing air needs to be raised (enlarged). However, when the air speed (air quantity) is raised (enlarged), a large number of sheets will be blown up at a time to disable reliable loosening in a case of thin (low basis weight) sheets. This causes plural sheets to be adsorbed by the adsorbing and conveying belt, which produces an issue of multi feed of the sheets. Also, when the conveying speed of the adsorbing and conveying belt is excessively raised, a thick (high basis weight) sheet will be kept adsorbed firmly by the belt due to an inertial force, which may bring about a jam caused by sheet feeding delay.

The present invention provides a sheet feeding apparatus and an image forming apparatus enabling stable sheet feeding even in a case where productivity of the image forming apparatus is enhanced.

SUMMARY OF THE INVENTION

The present invention provides a sheet feeding apparatus including a tray which supports sheets and enables lifting and lowering, an air blowing portion which blows air toward the sheets supported on the tray to blow up the sheets, and an adsorbing and conveying mechanism which adsorbs and conveys each of the blown-up sheets, and the adsorbing and conveying mechanism includes an adsorbing and conveying portion which adsorbs and conveys each of the sheets blown up by the air blowing, a negative pressure generating portion which generates negative pressure to make the adsorbing and conveying portion adsorb the sheet, and a timing controlling portion which controls a timing when a subsequent sheet is adsorbed by the adsorbing and conveying portion so that the subsequent sheet is overlapped at an overlapping amount with a preceding sheet adsorbed by the adsorbing and conveying portion.

The present invention enables stable sheet feeding even in a case where productivity of an image forming apparatus is enhanced by controlling timing when a subsequent sheet is adsorbed and conveying the subsequent sheet while partially overlapping the subsequent sheet with a preceding sheet.

Further features of the present invention will become apparent from the following description of exemplary embodiments with reference to the attached drawings.

BRIEF DESCRIPTION OF THE DRAWINGS

FIG. 7 is a table illustrating adsorbing time and adsorbing timing for each basis weight of a sheet;

FIG. 9 is a table illustrating adsorbing time and a sheet conveying speed of an adsorbing and conveying belt for each basis weight of a sheet in a sheet feeding device according to a second embodiment of the present invention;

FIGS. 11A and 11B are tables illustrating adsorbing time and adsorbing timing for each basis weight of a sheet in a sheet feeding device according to a third embodiment of the present invention.

DESCRIPTION OF THE EMBODIMENTS

Figure 1:
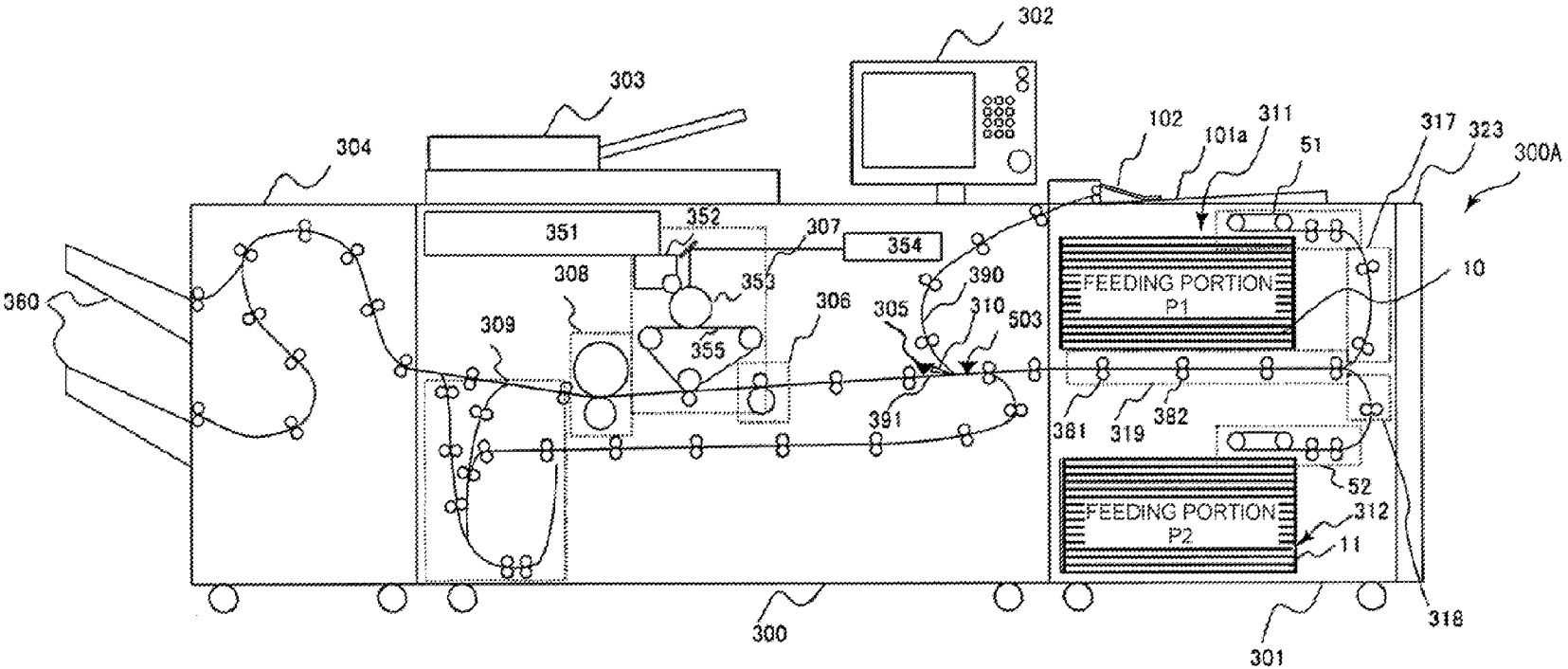
FIG. 1 is a schematic view of an image forming apparatus having a sheet feeding apparatus according to a first embodiment of the present invention.

Embodiments of the present invention will be described below with reference to the accompanying drawings. FIG. 1 is a schematic view of an image forming apparatus having a sheet feeding apparatus according to a first embodiment of the present invention. In FIG. 1, an image forming apparatus 300A includes an image forming apparatus main body (hereinafter referred to as apparatus main body) 300, an operation portion 302, a sheet feeding unit 301, and a sheet processing apparatus 304. Based on sheet processing setting set at the operation portion 302 or a not illustrated external host PC by a user and image information sent from a reader portion 303 or the external host PC, processing such as feeding and conveying of sheets, image forming, and stapling is performed.

The sheet feeding unit 301 has upper and lower sheet feeding devices 311 and 312. These sheet feeding devices 311 and 312 are provided with sheet storage cases 10 and 11 which store sheet bundles and adsorbing and conveying units 51 and 52 which feed the sheets stored in the sheet storage cases 10 and 11. In the present embodiment, the adsorbing and conveying units 51 and 52 adopt an air feeding method and feed the sheets while adsorbing the sheets on an endless belt at the time of a sheet feeding operation.

The sheet feeding unit 301 sequentially feeds and conveys the sheets in the respective sheet storage cases 10 and 11 according to sheet request information from the apparatus main body 300 and notifies preparation completion to the apparatus main body 300 after completion. The apparatus main body 300 receives the preparation completion from the sheet feeding unit 301 and notifies a delivery request. The sheet feeding unit 301 sequentially separates and feeds the sheets to the apparatus main body 300 one by one per notification of the delivery request, ends the operation after feeding as many sheets as requested, and comes to a standby state.

Sheets conveyed by the adsorbing and conveying unit 51 of the upper sheet feeding device 311 are fed to the apparatus main body 300 via an upper conveying portion 317 and a merged conveying portion 319. Also, sheets conveyed by the adsorbing and conveying unit 52 of the lower sheet feeding device 312 are fed to the apparatus main body 300 via a lower conveying portion 318 and the merged conveying portion 319. The respective conveying portions 317 to 319 are provided with not illustrated stepping motors for conveyance, and a conveyance controlling portion controls these motors and makes conveying rollers at the respective portions rotated, to feed the sheets.

On the upper surface of the sheet feeding unit 301 is provided an escape tray 101*a* which forcedly discharges abnormal sheets due to multi feed or a jam. A full-load detecting sensor 102 is provided to detect full load of sheets discharged to the escape tray 101*a*. Also, the respective conveyance paths of the sheet feeding unit 301 are provided with a plurality of not illustrated conveying sensors, which detects passing of the sheets on the respective conveyance paths.

The apparatus main body 300 is adapted to form an image on a sheet fed from the sheet feeding unit 301 and are provided on the upper surface the operation portion 302 allowing the user to do operation setting and at the upper portion the reader portion 303 reading an original image. Also, the apparatus main body 300 has an image forming portion 307 having a photosensitive drum 353, a laser scanner unit 354, a developing portion 352, and an intermediate transfer belt 355, a fixing portion 308, and a reverse conveying portion 309.

After the apparatus main body 300 receives a sheet from the sheet feeding unit 301, the apparatus main body 300 controls the respective conveying portions for sheet conveyance and performs an image forming operation at the image forming portion 307 based on received image data with sheet detection at an image reference sensor 305 set as a start point. When a jam sensor 503 detects an abnormal sheet, a switching member 310 is switched to guide the sheet to a sheet discharging path 390 and discharge the sheet to the escape tray 101*a*.

In the image forming operation, when the image reference sensor 305 detects a sheet, lighting and light quantity control of a not illustrated laser diode constituting the laser scanner unit 354 are performed, and a scanner motor which controls rotation of a not illustrated polygon mirror is controlled. By doing so, the photosensitive drum 353 is irradiated with laser light based on the image data, and a latent image is formed on the photosensitive drum 353.

Subsequently, at the developing portion 352, the latent image on the photosensitive drum 353 is developed as toner is supplied from a toner bottle 351, and a developed toner image is primarily transferred to the intermediate transfer belt 355. Thereafter, the toner image transferred on the intermediate transfer belt 355 is secondarily transferred to the sheet to form the toner image on the sheet. Meanwhile, a registration controlling portion 306 is provided immediately before the secondary transfer position. This registration controlling portion 306 performs sheet conveying controls for the sheet immediately before the transfer position such as correction of skew feeding of the sheet and fine adjustment and alignment between the toner image formed on the intermediate transfer belt 355 and the sheet front end position without stopping the sheet.

Subsequently, the sheet after the secondary transfer is conveyed to the fixing portion 308 and undergoes heat and pressure at the fixing portion 308 to cause the toner to be fused and fixed on the sheet. The sheet after fixing is conveyed to the reverse conveying portion 309 in a case where printing (image forming) is continued on the back side, or where the front side and the back side of the sheet are reversed, and to the downstream sheet processing apparatus 304 in a case where printing is ended. The sheet processing apparatus 304 performs desired processing (folding, stapling, or punching) set at the operation portion 302 by the user to the sheet on which the image has been formed discharged from the apparatus main body 300 and then sequentially outputs the sheet to a sheet discharge tray 360 as a final product.

Figure 2:
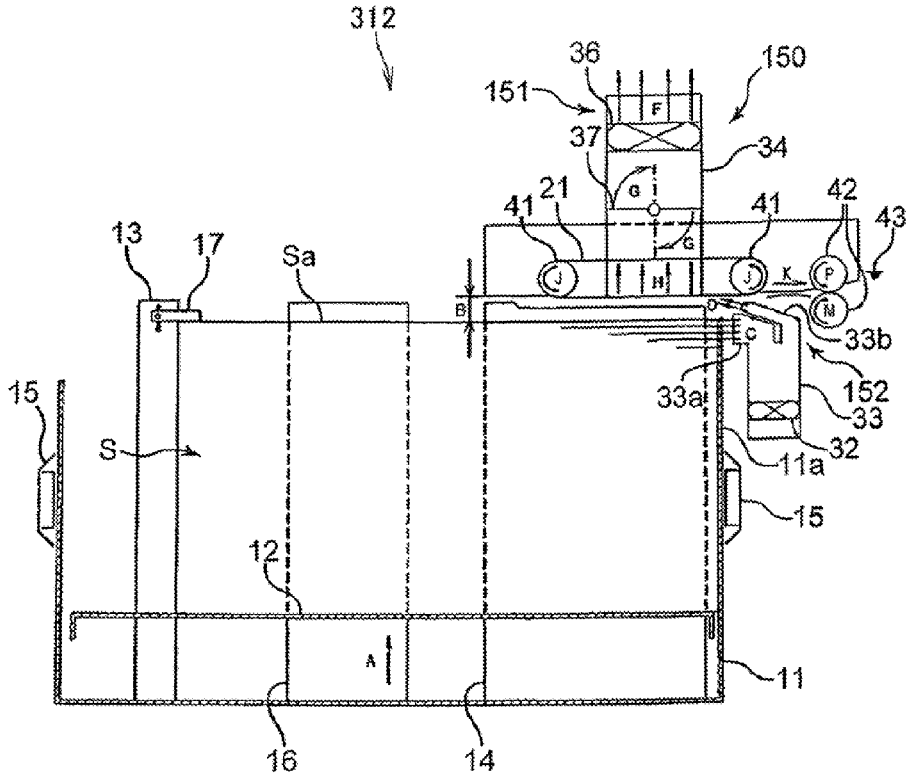
FIG. 2 illustrates a configuration of a sheet feeding device provided in a sheet feeding unit of the image forming apparatus.

FIG. 2 illustrates a configuration of the lower sheet feeding device 312 provided in the sheet feeding unit 301. It is to be noted that the upper sheet feeding device 311 has a similar configuration. The sheet storage case 11 has a tray 12 which loads and supports plural sheets S and enables lifting and lowering and a rear end restricting plate 13 which is a rear end restricting member abutting on a rear end of the sheet S as an end on the upstream side in a sheet feeding direction to restrict a position of the rear end. The sheet storage case 11 also has a front end restricting plate 11*a* which restricts a front end of the sheet S as an end on the downstream side in the sheet feeding direction, side end restricting plates 14 and 16 which restrict positions of the sheet S in a width direction as a direction perpendicular to the sheet feeding direction, and a sliding rail 15.

At the upper portion of the rear end restricting plate 13 is provided a sheet rear end presser 17 as a pressing member which presses the rear end portion of an uppermost sheet Sa and separates the sheet to be slidable in an up-down direction and turnable. When the sheet rear end presser 17 is lifted further upward than a predetermined position along with lifting of the tray 12, an after-mentioned CPU determines that the upper surface (hereinafter referred to as sheet surface) of the uppermost sheet Sa is high and controls the tray 12 to be lowered.

This sheet storage case 11 can be drawn from the sheet feeding unit 301 by the sliding rail 15. When the sheet storage case 11 is drawn, the tray 12 is lowered to a predetermined position for refilling or replacement of the sheets. Also, at the upper portion of this sheet storage case 11 is arranged a sheet feeding mechanism (hereinafter referred to as air feeding mechanism) 150 in an air feeding method that separates and feeds the sheets one by one. This air feeding mechanism 150 has an adsorbing and conveying mechanism 151 which adsorbs and conveys the sheets S loaded on the tray 12 and an air blowing portion 152 which causes an upper part of the sheet bundle on the tray to be blown up to loosen the sheets and separates the sheets S one by one.

The adsorbing and conveying mechanism 151 has an adsorbing and conveying belt 21 as an adsorbing and conveying portion which hangs along belt driving rollers 41 and adsorbs the sheet S and feeds it in a right direction in the figure and a suction fan 36 which generates negative pressure to make the adsorbing and conveying belt 21 adsorb the sheet S. The adsorbing and conveying mechanism 151 also has a suction duct 34 which is arranged on the inner side of the adsorbing and conveying belt 21 to suck air through not illustrated suction holes formed on the adsorbing and conveying belt 21. The adsorbing and conveying mechanism 151 further has a suction shutter 37 which is arranged in the suction duct 34 and turns ON/OFF an adsorbing operation of the adsorbing and conveying belt 21.

Also, the air blowing portion 152 has a loosening nozzle 33*a* and a separating nozzle 33*b* which make air blow the upper part of the sheet bundle from the front end side, a loosening fan 32, and a separating duct 33 which sends air from the loosening fan 32 to the respective nozzles 33*a* and 33*b*. Air sucked at the loosening fan 32 passes through the separating duct 33 and blows in an arrow C direction (approximately horizontal direction) by the loosening nozzle 33*a* to cause several sheets at the upper part of the sheets S loaded on the tray 12 to be blown up. Also, air blows in an arrow D direction by the separating nozzle 33*b* and separates the uppermost sheet Sa of the sheets blown up by the loosening nozzle 33*a* from the other sheets to make the adsorbing and conveying belt 21 adsorb the sheet.

Figure 3A:
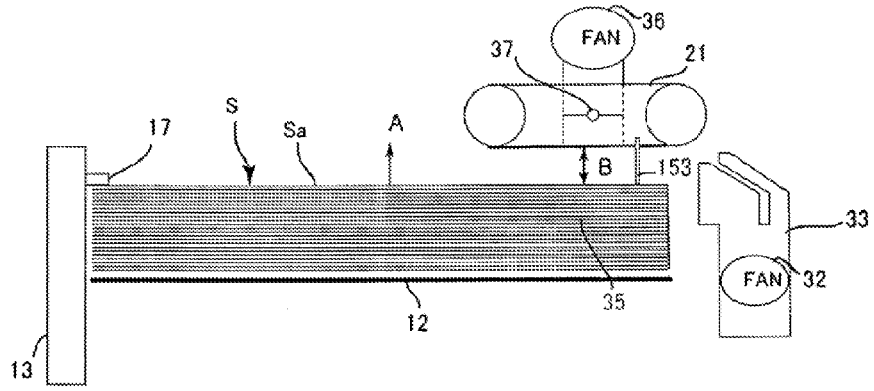
FIGS. 3A to 3D illustrate a sheet adsorbing and conveying operation of an adsorbing and conveying unit provided in the sheet feeding device.

Next, a sheet feeding operation of the sheet feeding unit 301 (air feeding mechanism 150) configured as above will be described. First, when the user draws the sheet storage case 11 (10), sets the sheets S, and puts away the sheet storage case 11 (10), the tray 12 starts lifting in an arrow A direction as illustrated in FIG. 3A. When the tray 12 reaches a feeding enabling position, at which a distance to the adsorbing and conveying belt 21 is B, the after-mentioned CPU makes the tray 12 stop at this position and then prepares for a sheet feeding signal to start feeding.

Figure 3B:
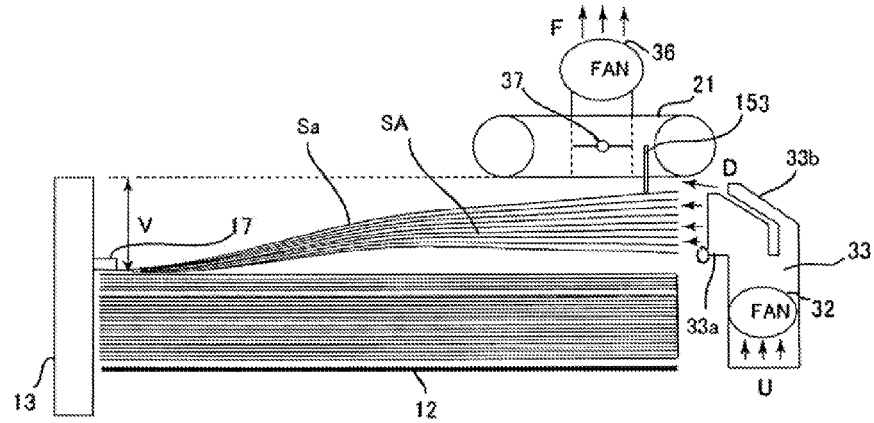

Subsequently, when the CPU detects the sheet feeding signal, the CPU operates the loosening fan 32 to suck air to the separating duct 33 in an arrow U direction as illustrated in FIG. 3B. The air blows via the separating duct 33 to the sheet bundle in arrows C and D directions by the loosening nozzle 33*a* and the separating nozzle 33*b*, respectively. This causes several sheets SA at the upper part of the sheet bundle to be blown up. Also, the CPU operates the suction fan 36 as a negative pressure generating portion to discharge air in an F direction in the figure.

At this time, the suction shutter 37 as an adsorption switching portion which can be switched between an adsorbing position to make the sheet adsorbed by negative pressure generated at the suction fan 36 and a blocking position to block the negative pressure is still closed. That is, the suction shutter 37 as the adsorption switching portion which can be switched between an adsorbing state to make the sheet adsorbed by the negative pressure generated at the suction fan 36 and a non-absorbing state to block the negative pressure and not to make the sheet adsorbed is still closed. Accordingly, since the suction shutter 37 is at the blocking position, the uppermost sheet Sa is never adsorbed by the adsorbing and conveying belt 21. Also, in this case, the rear end sheet surface detecting sensor 17 and a sheet surface detecting sensor 153 detect the sheet surface of the uppermost sheet Sa, and the position of the tray 12 is controlled so that the distance between the rear end sheet surface detecting sensor 17 and the adsorbing and conveying belt 21 in a vertical direction may be V.

Figure 3C:
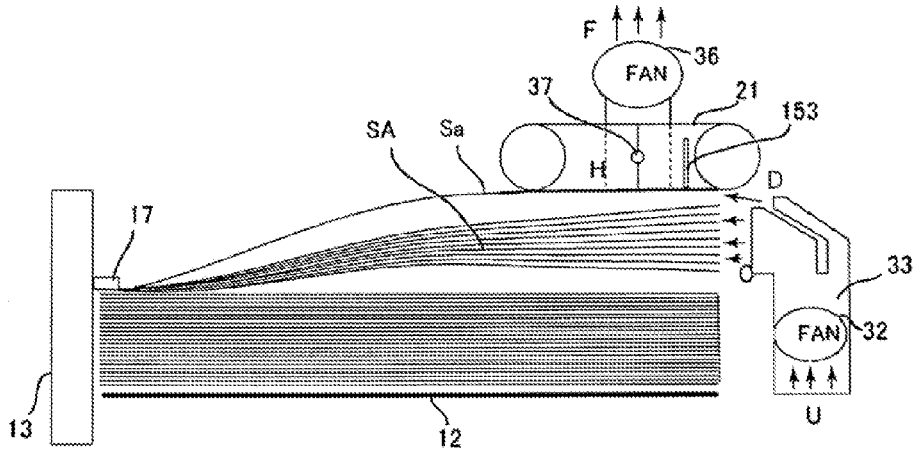

Subsequently, when a predetermined period of time has passed since detection of the sheet feeding signal, and the several sheets SA at the upper part are blown up in a stable manner, the CPU drives an after-mentioned suction solenoid to rotate the suction shutter 37 in an arrow G direction in FIG. 2 and move it to the adsorbing position. This causes air to be sucked in an arrow H direction from the suction holes provided on the adsorbing and conveying belt 21 and generates a suction force as illustrated in FIG. 3C. By this suction force and the separating air from the separating nozzle 33*b*, only the uppermost sheet Sa is adsorbed by the adsorbing and conveying belt 21.

Figure 3D:
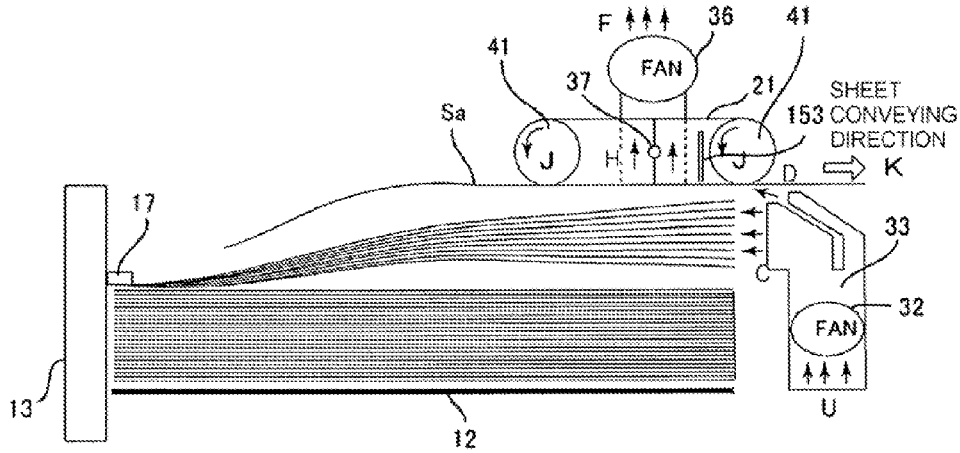

Subsequently, the CPU drives an after-mentioned feeding motor to rotate the belt driving rollers 41 in an arrow J direction illustrated in FIG. 3D. This causes the uppermost sheet Sa to be fed in an arrow K direction in a state of being adsorbed by the adsorbing and conveying belt 21 and thereafter to be conveyed by pullout rollers 42 which rotate in arrows P and M directions illustrated in FIG. 2 to the apparatus main body 300 via the lower conveying portion 318 (upper conveying portion 317) and the merged conveying portion 319. At the downstream of this pullout roller (pair) 42 is provided a pass sensor 43, and the CPU monitors passing of the sheet Sa by this pass sensor 43.

Figure 4:
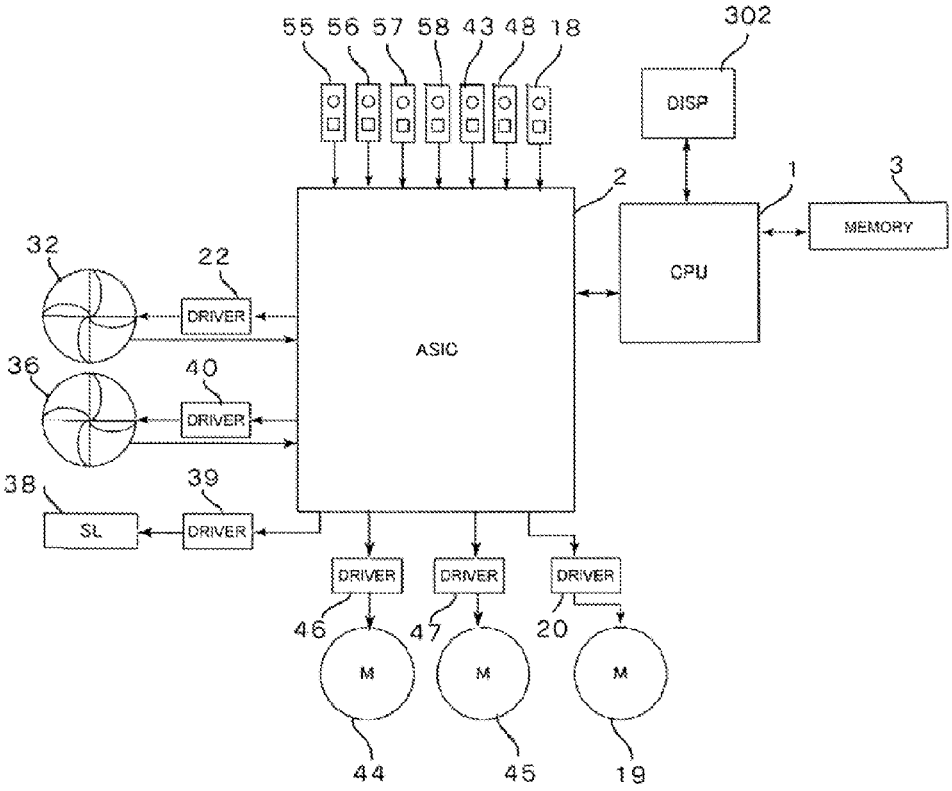
FIG. 4 is a control block diagram of the sheet feeding device.

FIG. 4 is a control block diagram of the sheet feeding unit 301 according to the present embodiment. In FIG. 4, a CPU 1 is a controlling portion which controls the sheet feeding unit 301 and is provided in the apparatus main body 300 in the present embodiment. To this CPU 1 is connected a dedicated ASIC 2 which outputs driving starting commands to driving circuits which drive various loads of the sheet feeding unit 301 such as motors and fans to drive the various loads. This ASIC 2 constitutes a timing controlling portion which controls timing when a subsequent sheet is adsorbed by the adsorbing and conveying belt 21 so that a part of the subsequent sheet may be conveyed while being overlapped at a predetermined overlapping amount with a preceding sheet adsorbed by the adsorbing and conveying belt 21 earlier, as described below.

To the CPU 1 is also connected the operation portion (DISP) 302 as a sheet information setting portion at which sheet information such as size, basis weight, and surface characteristics of sheets can be input. To the CPU 1 is further connected a memory unit 3 which stores adsorbing timing, a conveying speed of sheets, and the number of times of rotation of the suction fan corresponding to various data and sheet information input and set at the operation portion 302.

The CPU 1 refers to the data stored in the memory unit 3 and controls the distance B between the adsorbing and conveying belt 21 and the uppermost sheet Sa in the sheet storage case 10 or 11 according to the sheet information that the user has input from the operation portion 302. Meanwhile, instead of the operation portion 302, a not illustrated detecting portion which detects at least size information, basis weight information, and surface characteristics information of sheets as sheet information may be provided so as to input the sheet information to the CPU 1 from the detecting portion as an inputting portion.

Also, to the ASIC 2 are connected a sheet storing portion open/close sensor 48 which detects opening/closing states of the sheet storage case 11 (10), and a lower position detecting sensor 55 and an upper position detecting sensor 57 which detect a position of the tray 12 in the sheet storage case 11 (10). To the ASIC 2 are also connected a sheet surface detecting sensor 18 which detects the upper surface of a sheet loaded on the tray 12 and a sheet presence/absence detecting sensor 56 which detects presence/absence of sheets on the tray 12. To the ASIC 2 are further connected an adsorption completing sensor 58 which detects completion of sheet adsorption by monitoring a negative pressure state in the suction duct in a case where a sheet is adsorbed by the suction fan 36 and the pass sensor 43 which detects movement of sheets on the conveyance path and an overlapping amount of the sheets.

This ASIC 2 not only outputs the driving starting commands to the driving circuits which drive the various loads of the sheet feeding unit 301 but also receives rotation number signals (FG) of the loosening fan 32 and the suction fan 36 and performs PWM control so that the fans may be rotated as many times as the targeted number of times of rotation. In FIG. 4, a loosening fan driving circuit (driver) 22 sends a PWM signal output from the ASIC 2 and supplies power to the loosening fan 32. A suction fan driving circuit (driver) 40 sends a PWM signal output from the ASIC 2 and supplies power to the suction fan 36.

A driving circuit (driver) 39 is a driving circuit of a suction solenoid 38 which opens and closes the suction shutter 37 in the suction duct 34. A driving circuit (driver) 46 is a driving circuit of a feeding motor 44 which drives the belt driving rollers 41, and a driving circuit (driver) 47 is a driving circuit of a pullout motor 45 which drives the pullout rollers 42. Each of the feeding motor and the pullout motor is a pulse motor, and its motor rotating amount is controlled by the number of control pulses given to each of the driving circuits by the ASIC 2. A driving circuit (driver) 20 is a driving circuit of a lifter motor 19 which lifts and lowers the tray 12. The lifter motor is a DC motor, and its driving is controlled by ON/OFF. Meanwhile, the CPU 1, operation portion 302, memory unit 3, and the like are provided in the apparatus main body 300 in the present embodiment but may be provided in the sheet feeding unit 301.

Figure 5A:
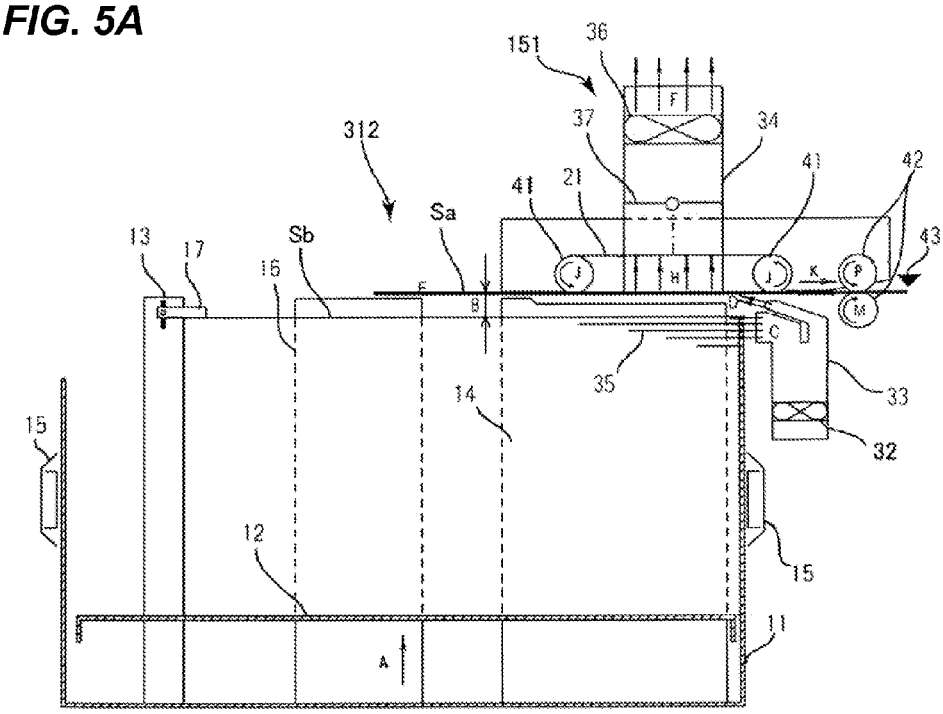
FIGS. 5A and 5B are first views illustrating a sheet overlapping conveyance operation of the sheet feeding device.

In the present embodiment, the above-mentioned adsorbing and conveying operation by the adsorbing and conveying belt 21 triggers a control in which the suction shutter 37 is closed when the preceding sheet (uppermost sheet) Sa illustrated in a solid line in FIG. 5A is moved as long as a predetermined length. The movement as long as the predetermined length is recognized, e.g., by detecting by a detecting unit that the front end has reached the pullout rollers 42 or that the front end of the preceding sheet Sa has proceeded as long as a predetermined distance or by counting time from the start of rotation of the adsorbing and conveying belt 21.

Figure 5B:
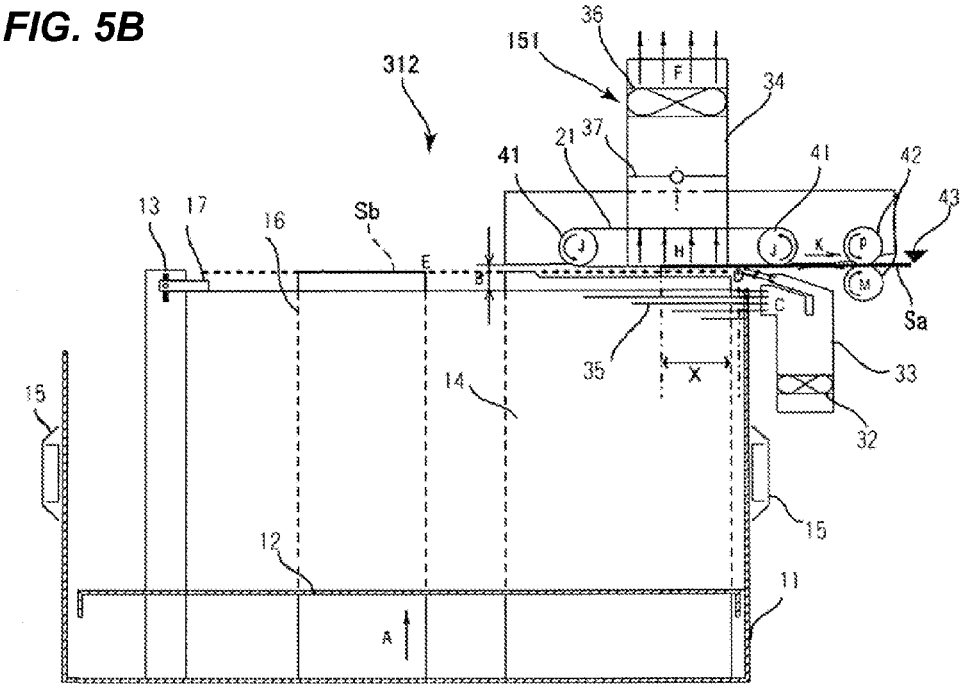

Thereafter, at a time point when the preceding sheet Sa has reached a predetermined position, a control in which the suction shutter 37 is rotated again in the arrow G direction as illustrated in FIG. 5B is triggered. By doing so, a sheet (subsequent sheet) Sb illustrated in a dotted line following the uppermost sheet Sa is adsorbed by the adsorbing and conveying belt 21 and is conveyed so that the subsequent sheet Sb may be overlapped with the preceding sheet Sa imbricately. In this manner, in the present embodiment, the suction shutter 37 is once closed in the middle of conveying the preceding sheet Sa and is thereafter opened to convey the two sheets Sa and Sb so as to be overlapped imbricately.

Figure 6:
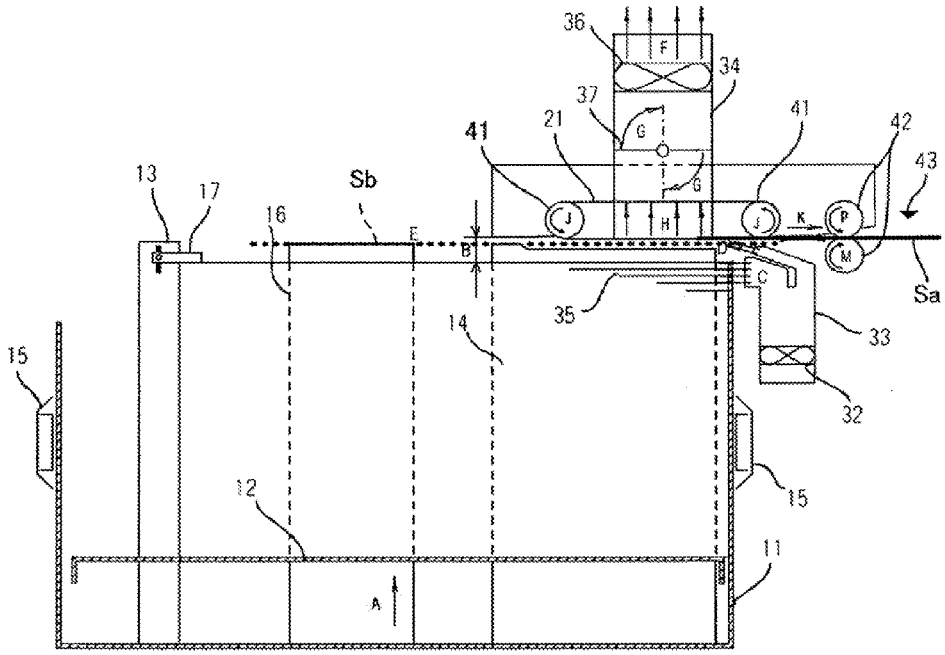
FIG. 6 is a second view illustrating the sheet overlapping conveyance operation of the sheet feeding device.

By setting timing of closing and opening of the suction shutter 37, the two sheets Sa and Sb can be conveyed with an overlapping amount X between the sheets as a predetermined value. Thereafter, the preceding sheet Sa and the subsequent sheet Sb are conveyed in the K direction by the adsorbing and conveying belt 21 in the imbricate state in which an optimal overlapping amount X is maintained as illustrated in FIG. 6. Subsequently, until the job ends, the states in FIGS. 5 and 6 are repeated under control.

However, an uppermost sheet is lower as the sheets are sequentially fed, along with which adsorbing time of the sheet is longer. Accordingly, the overlapping amount X may be changed (the value X may be smaller) gradually during conveying the sheets. To deal with this, the pass sensor 43 may detect the thickness of the sheets to detect the overlapping amount of the sheets (distance of the overlapped range in the sheet conveying direction). Based on the detection result of the pass sensor 43 as a detecting portion which detects the overlapping amount of the sheets, driving timing of the suction shutter 37 at the time of adsorption of the subsequent sheet may be controlled. This enables stable sheet feeding in a state where an optimal overlapping amount X is maintained. Alternatively, based on the sheet information set at the operation portion 302, driving timing of the suction shutter 37 may be controlled to maintain an optimal overlapping amount X between the preceding sheet Sa and the subsequent sheet Sb.

Meanwhile, the adsorbing time (time from the ON timing of the suction solenoid 38 to the ON timing of the adsorption completing sensor 58) differs with the basis weight of the sheet. Also, since the adsorbing and conveying belt 21 is driven at a constant speed V at all times in the present embodiment, the preceding sheet proceeds as long as V×t by the time when the subsequent sheet Sb is adsorbed by the adsorbing and conveying belt 21. Thus, in order to keep the overlapping amount X constant regardless of the basis weight of sheets, the ON timing of the suction shutter 37 needs to be earlier by V×t in advance, and the ON timing of the suction shutter 37 needs to be controlled (adjusted) depending on the adsorbing time according to the basis weight of the sheet.

Where a length of the sheet S in the sheet conveying direction is L, a predetermined overlapping amount is X, a sheet conveying speed is V, and adsorbing time is t, the ON timing of the suction shutter 37 is after the preceding sheet proceeds as long as L1 (=L−X−V×t) after being adsorbed by the adsorbing and conveying belt 21. It is to be noted that the adsorbing time t contains response time of the suction solenoid 38, response time of the suction shutter 37, and time until the sheet Sb is adsorbed by the adsorbing and conveying belt 21.

Meanwhile, in the present embodiment, an adsorbing time table for each basis weight of a sheet illustrated in FIG. 7 is stored in the memory unit 3. In this table, adsorbing time of an A4-size (length in the sheet conveying direction=210 mm) sheet (plain paper) is 60 msec as illustrated in FIG. 7, for example. In a case where the A4-size sheets (plain paper) are to be conveyed at 360 mm/sec to have an overlapping amount of 50 mm, the ON timing of the suction shutter 37 is 138.4 mm from the following equation.

$$L1=210-50-360\times0.06=138.4\text{ mm}$$

In other words, in a case where the sheets having the adsorbing time of 60 msec are to be conveyed to be overlapped, the suction shutter 37 shall be turned ON after the preceding sheet has been adsorbed and conveyed as long as 138.4 mm, that is, when the distance between the rear end of the preceding sheet and the front end of the subsequent sheet is (50+21.6) mm. It is to be noted that, in the present embodiment, the adsorbing time of ultra-thin paper is set to 20 msec while the adsorbing time of ultra-thick paper is set to 100 msec as illustrated in FIG. 7 based on examination data.

Accordingly, in a case where an optimal overlapping amount is 50 mm, the suction shutter 37 is controlled to be turned ON when the distance between the rear end of the preceding sheet and the front end of the subsequent sheet is (50+7.2) mm in a case of the ultra-thin paper or (50+36) mm in a case of the ultra-thick paper. It is to be noted that the OFF timing of the suction shutter 37 shall be after the subsequent sheet Sb illustrated in FIG. 5B is conveyed as long as a predetermined distance after reaching the pullout rollers 42 at the front end.

Meanwhile, after the sheets are overlapped by ON/OFF of the suction shutter 37 in such a manner, the overlapped sheet group needs to be separated one by one before being conveyed to the apparatus main body 300. To do so, in the present embodiment, when an overlapped part of the sheet group reaches between the conveying rollers 381 and 382 provided at the above-mentioned merged conveying portion 319 illustrated in FIG. 1, a conveying speed of the conveying rollers 381 will be heightened more than a conveying speed of the conveying rollers 382. This causes the preceding sheet to be separated from the subsequent sheet.

An accelerated velocity and a conveying speed after acceleration of the conveying rollers 381 are determined in consideration of an overlapping amount of sheets and sheet size. Also, after the preceding sheet Sa is separated from the subsequent sheet Sb, and the rear end of the preceding sheet Sa passes through the conveying rollers 381, and before the front end of the subsequent sheet Sb reaches the conveying rollers 381, the speed of the conveying rollers 381 needs to be equal to the speed of the conveying rollers 382.

Figure 8:
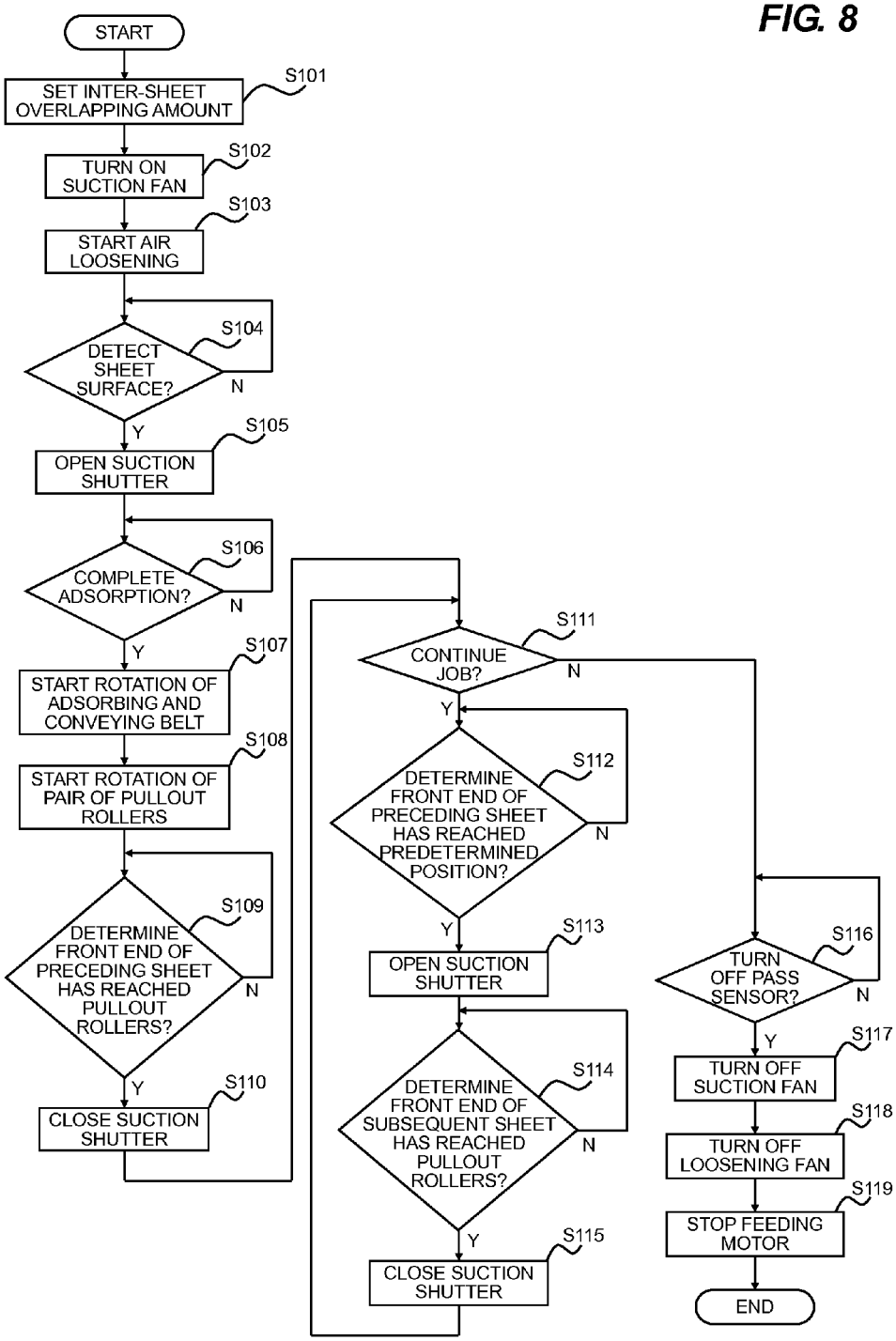
FIG. 8 is a flowchart illustrating a sheet feeding operation of the sheet feeding device.

FIG. 8 is a flowchart illustrating the sheet feeding operation of the sheet feeding unit 301 according to the present embodiment. To feed sheets, a user first draws the sheet storage case 11 (10) to set sheets S. When the sheet storage case 11 (10) is put away, the tray 12 lifts by the lifter motor 19 and stops at a position at which the distance between the adsorbing and conveying belt 21 and the uppermost sheet Sa is B (refer to FIG. 2).

Thereafter, when the CPU 1 receives a sheet feeding signal, an inter-sheet overlapping amount predetermined according to the basis weight of the sheets is set (S101). Also, sheet adsorbing timing is set. The sheet adsorbing timing is set with reference to sheet information set at the operation portion 302 and the adsorbing time table for each basis weight of a sheet illustrated in FIG. 7 stored in the memory unit 3.

Subsequently, a control signal is input in the suction fan driving circuit 40 to drive the suction fan 36 (S102). Similarly, a control signal is input in the loosening fan driving circuit to drive the loosening fan 32 to start air loosening (S103). A predetermined period of time passes until sheets are blown up by the air loosening in a stable manner, and thereafter time passes until the sheet surface detecting sensor 18 detects a sheet surface (S104). When the sheet surface detecting sensor 18 detects a sheet surface of the uppermost sheet Sa (Y at S104), a control signal is input in the suction solenoid driving circuit 39 to drive the suction solenoid 38 to open the suction shutter 37 in the suction duct 34 (S105). This causes air to be sucked from the suction holes provided on the adsorbing and conveying belt 21, generates a suction force in the arrow H direction in FIG. 2, and causes the uppermost sheet Sa to be adsorbed by the adsorbing and conveying belt 21.

Subsequently, when an output from the adsorption completing sensor 58 is monitored, and it is determined that adsorption of the uppermost sheet Sa is completed (Y at S106), a control signal is input in the feeding motor driving circuit 46 to drive the feeding motor 44 to start rotation of the adsorbing and conveying belt 21 (S107). Also, a control signal is input in the pullout motor driving circuit 47 to drive the pullout motor 45 to start rotation of the pullout rollers 42 (S108). It is to be noted that the rotation of the adsorbing and conveying belt 21 and the rotation of the pullout rollers 42 may be performed simultaneously, or the pullout rollers 42 may be controlled to be rotated earlier.

Subsequently, when it is determined by a not illustrated timer or the like that the front end of the sheet conveyed by the adsorbing and conveying belt 21 has reached the pullout rollers 42 (Y at S109), the suction shutter 37 is closed (S110). At this step, in order for the front end of the sheet to reach the pullout rollers 42 reliably, the suction shutter 37 is preferably controlled to be closed after the sheet is conveyed as long as a predetermined distance after the front end of the sheet has reached the pullout rollers 42.

Subsequently, it is determined if the job is in a continued state (S111). In a case where the job is in the continued state at this step (Y at S111), that is, in a case where the subsequent sheet presents, it is determined if the front end of the preceding sheet that has reached the pullout rollers 42 has reached a predetermined position, which is the preset sheet adsorbing timing as described above (S112). When it is determined that the front end of the preceding sheet has reached the predetermined position (Y at S112), the suction shutter 37 is opened (S113). By doing so, the subsequent sheet Sb is conveyed to be partially overlapped with the preceding sheet Sa while being adsorbed by the adsorbing and conveying belt 21, as illustrated in FIG. 5B described above.

In the present embodiment, although adsorbing timing of the subsequent sheet Sb, that is, timing to open the suction shutter 37, is controlled according to the adsorbing time table illustrated in FIG. 7 as a switching timing table, the timing may be controlled to have a predetermined overlapping amount. Also, the timing to open the suction shutter 37 may be controlled by detecting an overlapping amount between the preceding sheet Sa and the subsequent sheet Sb. Thereafter, when the front end of the subsequent sheet has reached the pullout rollers 42 (Y at S114), the suction shutter 37 is closed again (S115). Subsequently, it is determined again if the job is in the continued state (S111), and if so (Y at S111), the above-mentioned steps S112 to S115 are repeated.

Subsequently, when the job ends (N at S111), it is determined if the rear end of a final sheet has turned OFF the pass sensor 43. When the rear end of the final sheet has turned OFF the pass sensor 43 (Y at S116), the suction fan 36 is turned OFF (S117), and the loosening fan 32 is turned OFF (S118). Further, the feeding motor 44 is stopped (S119) to end the sequential flow. It is to be noted that the stop controls of the suction fan 36, the loosening fan 32, and the feeding motor 44 may be done at the same time.

In such a manner, in the present embodiment, after the sheet is adsorbed by the adsorbing and conveying belt 21, the suction shutter 37 is once switched to the blocking position and is then switched to the adsorbing position. Accordingly, regardless of the size, basis weight, and kind of sheets, the preceding sheet adsorbed by the adsorbing and conveying belt 21 earlier and the subsequent sheet can be adsorbed and conveyed while being overlapped partially at a predetermined overlapping amount.

In other words, in the present embodiment, timing when the subsequent sheet is adsorbed by the adsorbing and conveying belt 21 is controlled by controlling switching timing of the suction shutter 37. By controlling the timing when the subsequent sheet is adsorbed in such a manner, the subsequent sheet can be conveyed while being partially overlapped with the preceding sheet at a predetermined overlapping amount regardless of the size, basis weight, and kind of sheets.

As described above, by controlling the timing when the subsequent sheet is adsorbed and conveying the subsequent sheet while partially overlapping the subsequent sheet with the preceding sheet at a predetermined overlapping amount, high-accuracy and stable sheet overlapping conveyance can be done regardless of the size, basis weight, and kind of sheets. Consequently, high productivity can be secured without raising the sheet feeding speed from the sheet feeding unit 301, and a sheet feeding failure at the sheet feeding device can be prevented. Also, since the productivity can be enhanced without raising the sheet feeding speed, sheet feeding can be done with low energy consumption and low operating sound. Hence, by controlling the timing when the subsequent sheet is adsorbed and conveying the subsequent sheet while partially overlapping the subsequent sheet with the preceding sheet, stable sheet feeding can be done even in a case where productivity of the image forming apparatus 300A is enhanced.

Meanwhile, the configuration in which the ON timing of the suction shutter 37 is controlled according to the basis weight of sheets in order to keep the overlapping amount X of sheets having different adsorbing time with the basis weight constant in a case where the adsorbing and conveying belt 21 is driven at a constant speed V at all times has been described above. However, the present invention is not limited to this. For example, the ON timing of the suction shutter 37 may be constant, in which case the overlapping amount X can be constant by controlling the sheet conveying speed of the adsorbing and conveying belt 21 according to the basis weight of sheets.

Next, a second embodiment of the present invention, in which the overlapping amount X is constant by controlling the sheet conveying speed of the adsorbing and conveying belt 21 according to the basis weight of sheets, will be described.

In the present embodiment as well, the suction shutter 37 is controlled to be turned ON after a sheet proceeds as long as L1 (=L−X−V×t). That is, the suction shutter 37 is controlled to be turned ON after the preceding sheet is adsorbed by the adsorbing and conveying belt 21 and then proceeds as long as L1 (constant length). In this case, in order to keep the overlapping amount X constant as well as keeping the ON timing of the suction shutter 37 constant, the speed of the adsorbing and conveying belt 21 has only to be changed so that the distance V×t, by which the preceding sheet proceeds by the time when the subsequent sheet is adsorbed by the adsorbing and conveying belt 21, may be constant.

FIG. 9 is a table of absorbing time values and sheet conveying speeds of the adsorbing and conveying belt 21 enabling the ON timing of the suction shutter 37 to be constant as described above. This sheet conveying speed table is stored in the memory unit 3. According to this table, in a case where A4-size sheets (ultra-thin paper) having a basis weight to render adsorbing time 20 msec are to be conveyed at 360 mm/sec to have an overlapping amount of 50 mm, a length by which the preceding sheet proceeds after the suction shutter 37 is turned ON is 152.8 mm from the following equation.

$$L1=210-50-360\times0.02=152.8\text{ mm}$$

Thus, in the case of the ultra-thin paper, when the suction shutter 37 is turned ON at constant timing, the conveying distance of the preceding sheet is 152.8 mm. In other words, in the case of conveying the ultra-thin paper, whose adsorbing time is 20 msec, at an overlapping amount of 50 mm so as to have a distance between the rear end of the preceding sheet and the front end of the subsequent sheet of (50+7.2) mm, the feeding motor 44 is controlled so that the speed of the adsorbing and conveying belt 21 may be 360 mm/s.

On the other hand, in a case of conveying other A4-size sheets having a basis weight to render adsorbing time 100 msec with the ON timing of the suction shutter 37 constant, the sheet conveying speed of the adsorbing and conveying belt 21 has only to be controlled to be 72 mm/sec from the following equation.

$$V=(210-152.8-50)/100\text{ msec}=72\text{ mm/sec}$$

Also, in a case of conveying thick paper sheets, whose adsorbing time is 80 msec, at an overlapping amount of 50 mm, so as to have a distance between the rear end of the preceding sheet and the front end of the subsequent sheet of (50+7.2) mm, the speed of the adsorbing and conveying belt 21 is 90 mm/s. It is to be noted that the OFF timing of the suction shutter 37 shall be after the subsequent sheet Sb illustrated in FIG. 5B is conveyed as long as a predetermined distance after reaching the pullout rollers 42 at the front end.

Figure 10:
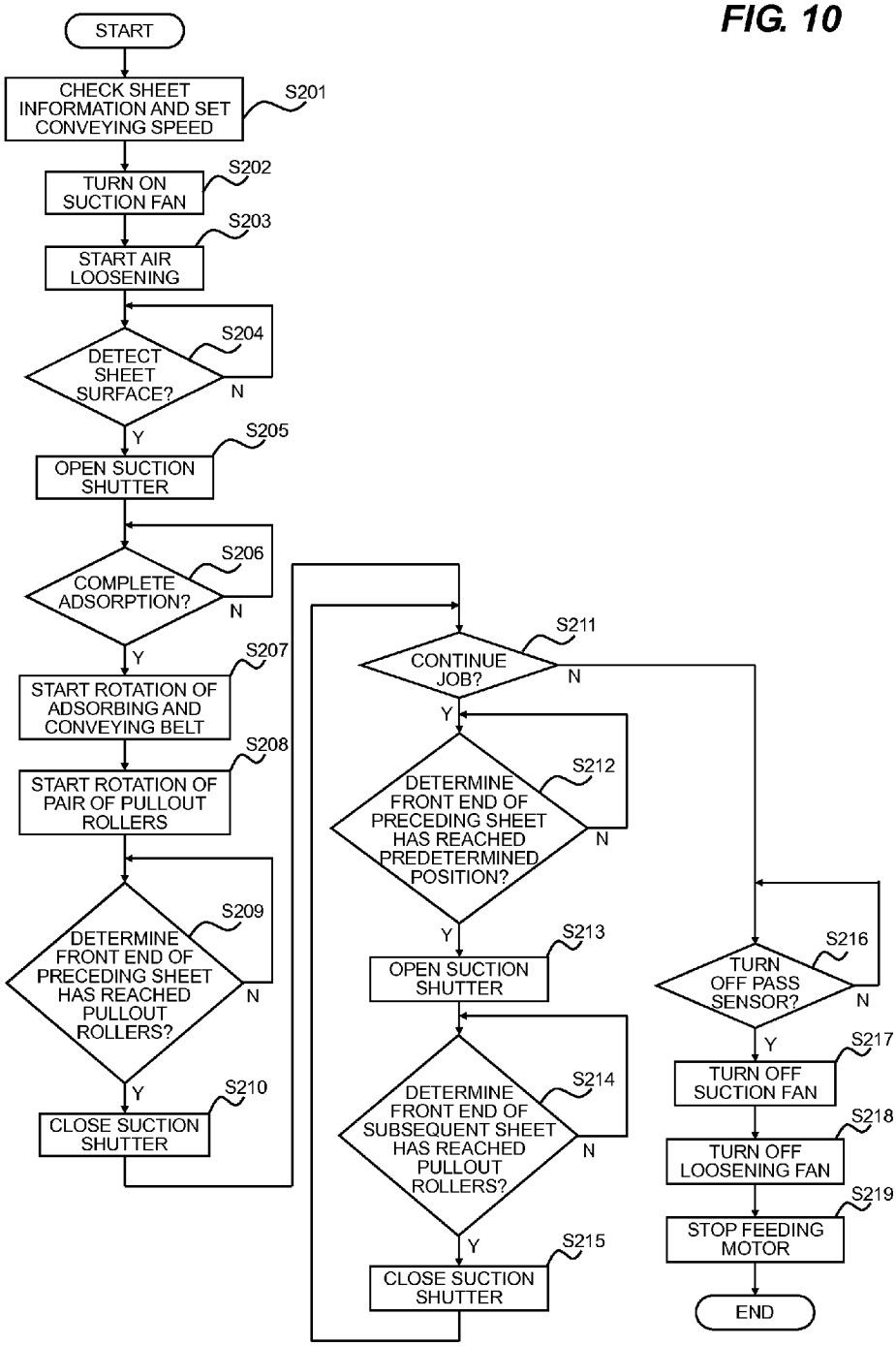
FIG. 10 is a flowchart illustrating a sheet feeding operation of the sheet feeding device.

FIG. 10 is a flowchart illustrating the sheet feeding operation of the sheet feeding unit 301 according to the present embodiment. To feed sheets, a user first draws the sheet storage case 11 (10) to set sheets S. When the sheet storage case 11 (10) is put away, the tray 12 lifts by the lifter motor 19 and stops at a position at which the distance between the adsorbing and conveying belt 21 and the uppermost sheet Sa is B (refer to FIG. 2).

Thereafter, when the CPU 1 receives a sheet feeding signal, a sheet conveying speed predetermined according to the basis weight of the sheets is set with reference to the sheet information (S201). Also, sheet adsorbing timing is set. The sheet adsorbing timing is set with reference to sheet information set at the operation portion 302 and the adsorbing time table for each basis weight of a sheet illustrated in FIG. 9 stored in the memory unit 3.

Subsequently, a control signal is input in the suction fan driving circuit 40 to drive the suction fan 36 (S202). Similarly, a control signal is input in the loosening fan driving circuit to drive the loosening fan 32 to start air loosening (S203). A predetermined period of time passes until sheets are blown up by the air loosening in a stable manner, and thereafter time passes until the sheet surface detecting sensor 18 detects a sheet surface (S204). When the sheet surface detecting sensor 18 detects a sheet surface of the uppermost sheet Sa (Y at S204), a control signal is input in the suction solenoid driving circuit 39 to drive the suction solenoid 38 to open the suction shutter 37 in the suction duct 34 (S205). This causes air to be sucked from the suction holes provided on the adsorbing and conveying belt 21, generates a suction force in the arrow H direction in FIG. 2, and causes the uppermost sheet Sa to be adsorbed by the adsorbing and conveying belt 21.

Subsequently, when an output from the adsorption completing sensor 58 is monitored, and it is determined that adsorption of the uppermost sheet Sa is completed (Y at S206), a control signal is input in the feeding motor driving circuit 46 to drive the feeding motor 44 to start rotation of the adsorbing and conveying belt 21 (S207). Also, a control signal is input in the pullout motor driving circuit 47 to drive the pullout motor 45 to start rotation of the pullout rollers 42 (S208). It is to be noted that the rotation of the adsorbing and conveying belt 21 and the rotation of the pullout rollers 42 may be performed simultaneously, or the pullout rollers 42 may be controlled to be rotated earlier. Also, the rotating speed of the adsorbing and conveying belt 21 and the rotating speed of the pullout rollers 42 are controlled based on the above-mentioned table according to the sheet information selected at step S201.

Subsequently, when it is determined that the front end of the sheet conveyed by the adsorbing and conveying belt 21 has reached the pullout rollers 42 (Y at S209), the suction shutter 37 is closed (S210). At this step, in order for the front end of the sheet to reach the pullout rollers 42 reliably, the suction shutter 37 is preferably controlled to be closed after the sheet is conveyed as long as a predetermined distance after the front end of the sheet has reached the pullout rollers 42.

Subsequently, it is determined if the job is in a continued state (S211). In a case where the job is in the continued state at this step (Y at S211), that is, in a case where the subsequent sheet presents, it is determined if the front end of the preceding sheet that has reached the pullout rollers 42 has reached a predetermined position, which is the preset sheet adsorbing timing as described above (S212). When it is determined that the front end of the preceding sheet has reached the predetermined position (Y at S212), the suction shutter 37 is opened (S213). By doing so, the subsequent sheet Sb is conveyed to be partially overlapped with the preceding sheet Sa while being adsorbed by the adsorbing and conveying belt 21, as illustrated in FIG. 5B described above. Thereafter, when the front end of the subsequent sheet has reached the pullout rollers 42 (Y at S214), the suction shutter 37 is closed again (S215). Subsequently, it is determined again if the job is in the continued state (S211), and if so (Y at S211), the above-mentioned steps S212 to S215 are repeated.

Subsequently, when the job ends (N at S211), it is determined if the rear end of a final sheet has turned OFF the pass sensor 43. When the rear end of the final sheet has turned OFF the pass sensor 43 (Y at S216), the suction fan 36 is turned OFF (S217), and the loosening fan 32 is turned OFF (S218). Further, the feeding motor 44 is stopped (S219) to end the sequential flow. It is to be noted that the stop controls of the suction fan 36, the loosening fan 32, and the feeding motor 44 may be done at the same time.

In such a manner, in the present embodiment, timing when the subsequent sheet is adsorbed is controlled by controlling the sheet conveying speed based on at least one sheet information category out of size, basis weight, and kind of sheets. By controlling the timing when the subsequent sheet is adsorbed by controlling the sheet conveying speed in such a manner, the subsequent sheet can be conveyed while being partially overlapped with the preceding sheet at a predetermined overlapping amount regardless of the size, basis weight, and kind of sheets.

Meanwhile, in the present embodiment, the configuration in which the sheet conveying speed of the adsorbing and conveying belt 21 is controlled according to the basis weight of sheets in order to keep the overlapping amount X constant in a case where the ON timing of the suction shutter 37 is constant has been described. However, the present invention is not limited to this. For example, by controlling the number of times of rotation of the suction fan 36 to keep adsorbing time constant regardless of the basis weight of sheets, the ON timing of the suction shutter 37 and the sheet conveying speed can be constant.

Next, a third embodiment of the present invention, in which, by controlling the number of times of rotation of the suction fan 36 to keep adsorbing time constant regardless of the basis weight of sheets, the ON timing of the suction shutter 37 and the sheet conveying speed are constant, will be described.

In the present embodiment as well, the suction shutter 37 is controlled to be turned ON after a sheet proceeds as long as L1 (=L−X−V×t). That is, the suction shutter 37 is controlled to be turned ON after the preceding sheet is adsorbed by the adsorbing and conveying belt 21 and then proceeds as long as L1 (constant length). In this case, in order to keep the overlapping amount X constant as well as keeping the ON timing of the suction shutter 37 and the sheet conveying speed constant, the number of times of rotation of the suction fan 36 has only to be changed to control the strength of the negative pressure so that the adsorbing time of the subsequent sheet may be constant.

For example, in a case of conveying A4-size (length in the sheet conveying direction=210 mm) ultra-thin paper sheets when the suction fan 36 is rotated at 1200 rpm, the adsorbing time is 20 msec as illustrated in FIG. 11A. In a case where the sheets are to be conveyed at 360 mm/sec to have an overlapping amount of 50 mm with the ON timing of the suction shutter 37 constant, a length (distance) by which the preceding sheet proceeds is 152.8 mm from the following equation.

$$L1=210-50-360\times0.02=152.8\text{ mm}$$

In such a manner, in the case where the sheets whose adsorbing time is 20 msec are to be conveyed while being overlapped with the ON timing of the suction shutter 37 constant, the conveying distance of the preceding sheet is 152.8 mm. Also, in a case of conveying other A4-size sheets having a basis weight to render adsorbing time 100 msec with the ON timing of the suction shutter 37 constant when the suction fan 36 is rotated at 1200 rpm, a length by which the preceding sheet proceeds is 124 mm from the following equation.

$$L1=210-50-360\times0.1=124\text{ mm}$$

In such a manner, in the case where the sheets whose adsorbing time is 100 msec are to be conveyed while being overlapped with the ON timing of the suction shutter 37 constant, the distance between the ends of the sheets is (50+36) mm. Accordingly, in a case where the sheet conveying speed of the adsorbing and conveying belt 21 and the ON timing of the suction shutter 37 are constant, the length by which the preceding sheet proceeds differs with the basis weight.

In the present embodiment, the suction fan driving circuit 40 is controlled according to the basis weight of sheets to change the number of times of rotation of the suction fan 36 to control the strength of the negative pressure. For example, in a case where an optimal overlapping amount is 50 mm, the number of times of rotation of the suction fan 36 is controlled so that the distance between the rear end of the preceding sheet and the front end of the subsequent sheet may be (50+7.2) mm regardless of the basis weight of sheets. FIG. 11B is an adsorbing time table as a negative pressure table for each basis weight of sheets, and this adsorbing time table is stored in the memory unit 3.

According to this adsorbing time table, in a case of sheets having a basis weight to render adsorbing time 100 msec, the suction fan 36 is rotated at 4800 rpm to have adsorbing time of 20 msec. By doing so, the overlapping amount X can be constant while the ON timing of the suction shutter 37 and the sheet conveying speed are constant. It is to be noted that the OFF timing of the suction shutter 37 shall be after the subsequent sheet (dotted line) illustrated in FIG. 6 is conveyed as long as a predetermined distance after reaching the pullout rollers 42 at the front end.

Figure 12:
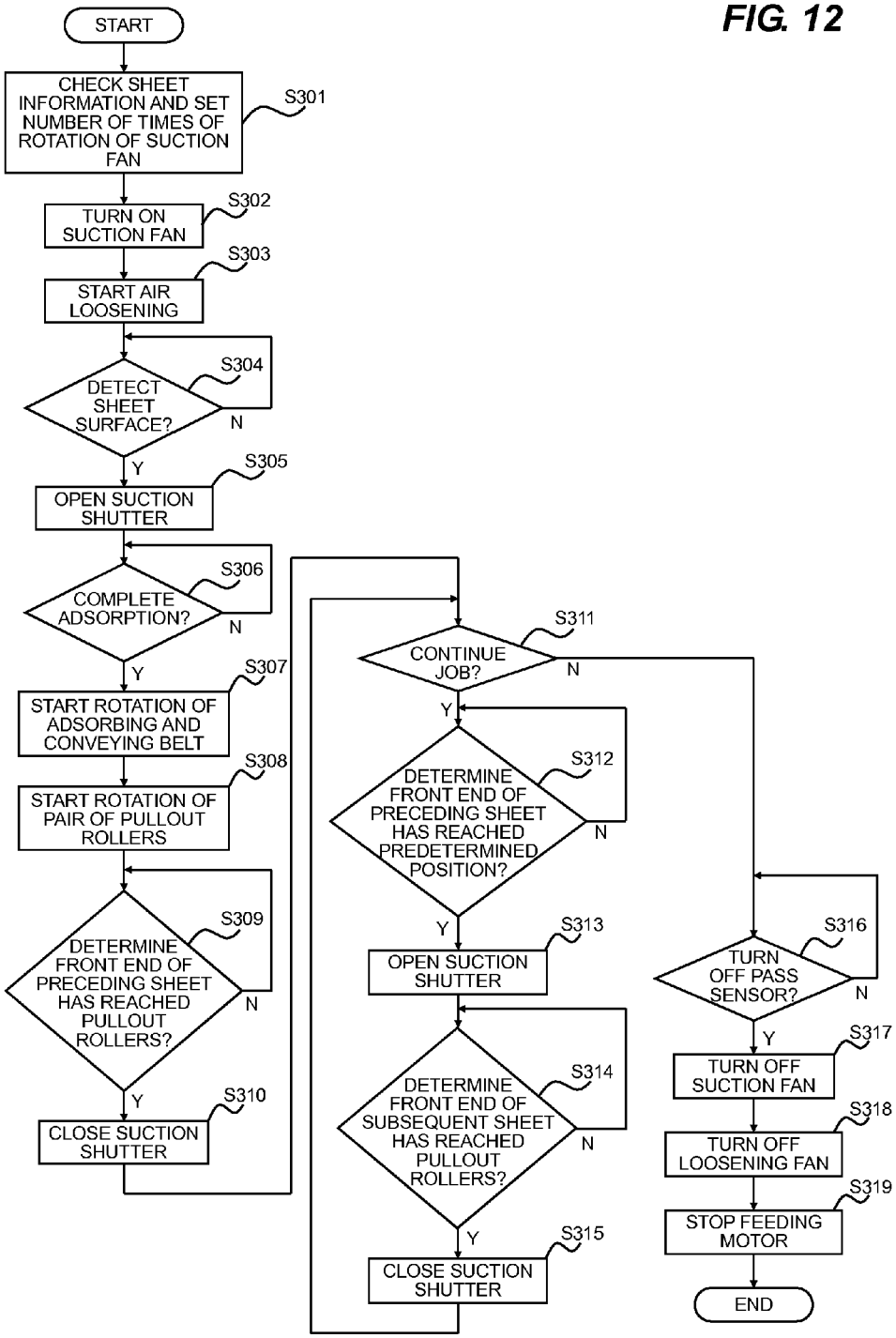
FIG. 12 is a flowchart illustrating a sheet feeding operation of the sheet feeding device.

FIG. 12 is a flowchart illustrating the sheet feeding operation of the sheet feeding unit 301 according to the present embodiment. To feed sheets, a user first draws the sheet storage case 11 (10) to set sheets S. When the sheet storage case 11 (10) is put away, the tray 12 lifts by the lifter motor 19 and stops at a position at which the distance between the adsorbing and conveying belt 21 and the uppermost sheet Sa is B (refer to FIG. 2).

Thereafter, when the CPU 1 receives a sheet feeding signal, the number of times of rotation of the suction fan 36 is set with reference to the memory storing sheet information (S301). Thereafter, a control signal is input in the suction fan driving circuit 40 to drive the suction fan 36 (S302). The number of times of rotation of the suction fan 36 is set with reference to the sheet information set at the operation portion 302 and the adsorbing time table illustrated in FIG. 11B stored in the memory unit 3. Similarly, a control signal is input in the loosening fan driving circuit to drive the loosening fan 32 to start air loosening (S303).

A predetermined period of time passes until sheets are blown up by the air loosening in a stable manner, and thereafter time passes until the sheet surface detecting sensor 18 detects a sheet surface (S304). When the sheet surface detecting sensor 18 detects a sheet surface of the uppermost sheet Sa (Y at S304), a control signal is input in the suction solenoid driving circuit 39 to drive the suction solenoid 38 to open the suction shutter 37 in the suction duct 34 (S305). This causes air to be sucked from the suction holes provided on the adsorbing and conveying belt 21, generates a suction force in the arrow H direction in FIG. 2, and causes the uppermost sheet Sa to be adsorbed by the adsorbing and conveying belt 21.

Subsequently, when an output from the adsorption completing sensor 58 is monitored, and it is determined that adsorption of the uppermost sheet Sa is completed (Y at S306), a control signal is input in the feeding motor driving circuit 46 to drive the feeding motor 44 to start rotation of the adsorbing and conveying belt 21 (S307). Also, a control signal is input in the pullout motor driving circuit 47 to drive the pullout motor 45 to start rotation of the pullout rollers 42 (S308). It is to be noted that the rotation of the adsorbing and conveying belt 21 and the rotation of the pullout rollers 42 may be performed simultaneously, or the pullout rollers 42 may be controlled to be rotated earlier.

Subsequently, when it is determined by a not illustrated timer or the like that the front end of the sheet conveyed by the adsorbing and conveying belt 21 has reached the pullout rollers 42 (Y at S309), the suction shutter 37 is closed (S310). At this step, in order for the front end of the sheet to reach the pullout rollers 42 reliably, the suction shutter 37 is preferably controlled to be closed after the sheet is conveyed as long as a predetermined distance after the front end of the sheet has reached the pullout rollers 42.

Subsequently, it is determined if the job is in a continued state (S311). In a case where the job is in the continued state at this step (Y at S311), that is, in a case where the subsequent sheet presents, it is determined if the front end of the preceding sheet that has reached the pullout rollers 42 has reached a predetermined position, which is the preset sheet adsorbing timing as described above (S312). When it is determined that the front end of the preceding sheet has reached the predetermined position (Y at S312), the suction shutter 37 is opened (S313). By doing so, the subsequent sheet Sb is conveyed to be partially overlapped with the preceding sheet Sa while being adsorbed by the adsorbing and conveying belt 21, as illustrated in FIG. 5B described above.

Thereafter, when the front end of the subsequent sheet has reached the pullout rollers 42 (Y at S314), the suction shutter 37 is closed again (S315). Subsequently, it is determined again if the job is in the continued state (S311), and if so (Y at S311), the above-mentioned steps S312 to S315 are repeated.

Subsequently, when the job ends (N at S311), it is determined if the rear end of a final sheet has turned OFF the pass sensor 43. When the rear end of the final sheet has turned OFF the pass sensor 43 (Y at S316), the suction fan 36 is turned OFF (S317), and the loosening fan 32 is turned OFF (S318). Further, the feeding motor 44 is stopped (S319) to end the sequential flow. It is to be noted that the stop controls of the suction fan 36, the loosening fan 32, and the feeding motor 44 may be done at the same time.

In such a manner, in the present embodiment, timing when the subsequent sheet is adsorbed is controlled by controlling the number of times of rotation of the suction fan 36 based on at least one sheet information category out of size, basis weight, and kind of sheets. By controlling the timing when the subsequent sheet is adsorbed by controlling the number of times of rotation of the suction fan 36 in such a manner, the subsequent sheet can be conveyed while being partially overlapped with the preceding sheet at a predetermined overlapping amount regardless of the size, basis weight, and kind of sheets.

Meanwhile, in the foregoing description, the operation portion 302 at which sheet information such as size, basis weight, and kind (surface characteristics) of sheets can be input and the memory unit 3 which stores various data input at the operation portion 302 and targeted values and PWM values used for fan control are directly connected to the CPU 1. However, there is no issue in inputting and storing sheet information with use of other units of the image forming apparatus such as the operation portion 302 and the memory unit 3, and there is no issue in using sheet information automatically recognized in the sheet feeding unit, not sheet information input at the operation portion 302.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-188240, filed Aug. 25, 2010, which is hereby incorporated by reference herein in its entirety.

What is claimed is:

1. A sheet feeding apparatus comprising a tray which supports sheets and enables lifting and lowering, an air blowing portion which blows air toward the sheets supported on the tray to blow up the sheet, and an adsorbing and conveying mechanism which adsorbs and conveys the blown-up sheet, the adsorbing and conveying mechanism including:

an adsorbing and conveying portion which adsorbs and conveys the sheet blown up by the air blowing portion;

a negative pressure generating portion which generates negative pressure to make the adsorbing and conveying portion adsorb the sheet;

an adsorption switching portion which switches the adsorbing and conveying portion between an adsorbing state to adsorb the sheet by the negative pressure generated at the negative pressure generating portion and a non-absorbing state to not adsorb the sheet; and a timing controlling portion which controls a timing of a switching between the adsorbing state and the non-adsorbing state of the adsorption switching portion, wherein while a preceding sheet is conveyed by the adsorbing and conveying portion, the adsorbing and conveying portion is switched to the non-adsorbing state and thereafter the adsorbing and conveying portion is switched to the adsorbing state so that a subsequent sheet is overlapped partially with the preceding sheet adsorbed by the adsorbing and conveying portion.

2. The sheet feeding apparatus according to claim 1, further comprising:

a sheet information setting portion which sets sheet information; and a switching timing table according to the sheet information, wherein the timing controlling portion controls the switching timing of the adsorption switching portion so that the preceding sheet and the subsequent sheet are conveyed while being overlapped at a predetermined overlapping amount based on the sheet information set at the sheet information setting portion and the switching timing table.

3. The sheet feeding apparatus according to claim 1, further comprising:

a detecting portion which detects an overlapping amount between the preceding sheet and the subsequent sheet, wherein the timing controlling portion controls the switching timing of the adsorption switching portion so that the preceding sheet and the subsequent sheet are conveyed while being overlapped at a predetermined overlapping amount based on a detection result by the detecting portion.

4. The sheet feeding apparatus according to claim 1, wherein the timing controlling portion controls a sheet conveying speed of the adsorbing and conveying portion so that the preceding sheet and the subsequent sheet are conveyed while being overlapped at a predetermined overlapping amount.

5. The sheet feeding apparatus according to claim 4, further comprising:

a sheet information setting portion which sets sheet information; and a sheet conveying speed table according to the sheet information, wherein the timing controlling portion controls the sheet conveying speed of the adsorbing and conveying portion so that the preceding sheet and the subsequent sheet are conveyed while being overlapped at a predetermined overlapping amount based on the sheet information set at the sheet information setting portion and the sheet conveying speed table.

6. The sheet feeding apparatus according to claim 1, wherein the timing controlling portion controls a strength of the negative pressure generated by the negative pressure generating portion so that the preceding sheet and the subsequent sheet are conveyed while being overlapped at a predetermined overlapping amount.

7. The sheet feeding apparatus according to claim 6, further comprising:

a sheet information setting portion which sets sheet information; and a negative pressure table according to the sheet information, wherein the timing controlling portion controls the strength of the negative pressure generated by the negative pressure generating portion so that the preceding sheet and the subsequent sheet are conveyed while being overlapped at the predetermined overlapping amount based on the sheet information set at the sheet information setting portion and the negative pressure table.

8. The sheet feeding apparatus according to claim 7, wherein the negative pressure generating portion is a fan, and the timing controlling portion controls a number of times of rotation of the fan so that the overlapping amount may be the predetermined overlapping amount based on the sheet information and the negative pressure table.

9. An image forming apparatus comprising:

an image forming portion; and a sheet feeding apparatus including a tray which supports sheets and enables lifting and lowering, an air blowing portion which blows air toward the sheets supported on the tray to blow up the sheet, and an adsorbing and conveying mechanism which adsorbs and conveys the blown-up sheet, wherein the adsorbing and conveying mechanism includes:

an adsorbing and conveying portion which adsorbs and conveys the sheet blown up by the air blowing;

a negative pressure generating portion which generates negative pressure to make the adsorbing and conveying portion adsorb the sheet;

an adsorption switching portion which switches the adsorbing and conveying portion between an adsorbing state to adsorb the sheet by the negative pressure generated at the negative pressure generating portion and a non-absorbing state to not adsorb the sheet; and a timing controlling portion which controls a timing of a switching between the adsorbing state and the non-adsorbing state of the adsorption switching portion, wherein while a preceding sheet is conveyed by the adsorbing and conveying portion, the adsorbing and conveying portion is switched to the non-adsorbing state and thereafter the adsorbing and conveying portion is switched to the adsorbing state so that a subsequent sheet is overlapped partially with the preceding sheet adsorbed by the adsorbing and conveying portion.

10. The image forming apparatus according to claim 9, further comprising:

a sheet information setting portion which sets sheet information; and a switching timing table according to the sheet information, wherein the timing controlling portion controls the switching timing of the adsorption switching portion so that the preceding sheet and the subsequent sheet may be conveyed while being overlapped at a predetermined overlapping amount based on the sheet information set at the sheet information setting portion and the switching timing table.

11. The image forming apparatus according to claim 9, further comprising:

a detecting portion which detects an overlapping amount between the preceding sheet and the subsequent sheet, wherein the timing controlling portion controls the switching timing of the adsorption switching portion so that the preceding sheet and the subsequent sheet are conveyed while being overlapped at a predetermined overlapping amount based on a detection result by the detecting portion.

12. The image forming apparatus according to claim 9, wherein the timing controlling portion controls a sheet conveying speed of the adsorbing and conveying portion so that the preceding sheet and the subsequent sheet are conveyed while being overlapped at a predetermined overlapping amount.

13. The image forming apparatus according to claim 12, further comprising:

a sheet information setting portion which sets sheet information; and a sheet conveying speed table according to the sheet information, wherein the timing controlling portion controls the sheet conveying speed of the adsorbing and conveying portion so that the preceding sheet and the subsequent sheet are conveyed while being overlapped at a predetermined overlapping amount based on the sheet information set at the sheet information setting portion and the sheet conveying speed table.

14. The image forming apparatus according to claim 9, wherein the timing controlling portion controls a strength of the negative pressure generated by the negative pressure generating portion so that the preceding sheet and the subsequent sheet are conveyed while being overlapped at a predetermined overlapping amount.

15. The image forming apparatus according to claim 14, further comprising:

a sheet information setting portion which sets sheet information; and a negative pressure table according to the sheet information, wherein the timing controlling portion controls the strength of the negative pressure generated by the negative pressure generating portion so that the preceding sheet and the subsequent sheet are conveyed while being overlapped at a predetermined overlapping amount based on the sheet information set at the sheet information setting portion and the negative pressure table.

16. The image forming apparatus according to claim 15, wherein the negative pressure generating portion is a fan, and the timing controlling portion controls a number of times of rotation of the fan so that the overlapping amount may be the predetermined overlapping amount based on the sheet information and the negative pressure table.

* * * * *